US009865442B2

(12) United States Patent
Giles et al.

(10) Patent No.: US 9,865,442 B2
(45) **Date of Patent: *Jan. 9, 2018**

(54) CURVED ION GUIDE WITH NON MASS TO CHARGE RATIO DEPENDENT CONFINEMENT

(71) Applicant: Micromass UK Limited, Wilmslow (GB)

(72) Inventors: Kevin Giles, Stockport (GB); Martin Raymond Green, Bowdon (GB); Daniel James Kenny, Knutsford (GB); Jason Lee Wildgoose, Stockport (GB); David J. Langridge, Macclesfield (GB)

(73) Assignee: MICROMASS UK LIMITED, Wilmslow (GB)

( * ) Notice: Subject to any disclaimer, the term of this patent is extended or adjusted under 35 U.S.C. 154(b) by 0 days.

This patent is subject to a terminal disclaimer.

(21) Appl. No.: 14/838,649

(22) Filed: Aug. 28, 2015

(65) Prior Publication Data

US 2015/0371838 A1 Dec. 24, 2015

Related U.S. Application Data

(63) Continuation of application No. 14/001,078, filed as application No. PCT/GB2012/050432 on Feb. 24, 2012, now Pat. No. 9,123,518.

(60) Provisional application No. 61/475,912, filed on Apr. 15, 2011.

(30) Foreign Application Priority Data

Feb. 25, 2011 (GB) ..... 1103255.4

(51) Int. Cl.
*H01J 49/26* (2006.01)
*H01J 49/06* (2006.01)
*H01J 49/42* (2006.01)

(52) U.S. Cl.
CPC ..... *H01J 49/063* (2013.01); *H01J 49/065* (2013.01); *H01J 49/26* (2013.01); *H01J 49/42* (2013.01)

(58) Field of Classification Search
CPC ..... H01J 49/063; H01J 49/065; H01J 49/26; H01J 49/42
USPC ..... 250/281, 282, 283
See application file for complete search history.

(56) References Cited

U.S. PATENT DOCUMENTS

| | | | | |
|---|---|---|---|---|
| 6,417,511 | B1 | 7/2002 | Russ et al. | |
| 6,891,157 | B2 | 5/2005 | Bateman et al. | |
| 7,309,861 | B2 | 12/2007 | Brown et al. | |
| 7,405,401 | B2 | 7/2008 | Hoyes | |
| 7,459,678 | B2 | 12/2008 | Schoen | |
| 7,829,842 | B2 | 11/2010 | Makarov | |
| 7,923,681 | B2 | 4/2011 | Collings et al. | |
| 8,030,613 | B2 | 10/2011 | Makarov et al. | |
| 8,552,366 | B2 | 10/2013 | Hoyes | |
| 8,658,969 | B2 | 2/2014 | Nichiguchi | |
| 8,957,368 | B2 | 2/2015 | Kenny | |
| 9,123,518 | B2 * | 9/2015 | Giles | H01J 49/065 |
| 2009/0173880 | A1 * | 7/2009 | Bateman | H01J 49/065 250/292 |

(Continued)

*Primary Examiner* — Nicole Ippolito

(57) ABSTRACT

A non-linear ion guide is disclosed comprising a plurality of electrodes. An ion guiding region is arranged between the electrodes, and the ion guiding region curves at least in a first direction. A DC voltage is applied to at least some of the electrodes in order to form a DC potential well which acts to confine ions within the ion guiding region in the first direction.

20 Claims, 5 Drawing Sheets

(56) References Cited

U.S. PATENT DOCUMENTS

2010/0038530 A1 2/2010 Giles et al.

* cited by examiner

CURVED ION GUIDE WITH NON MASS TO CHARGE RATIO DEPENDENT CONFINEMENT

CROSS-REFERENCE TO RELATED APPLICATION

This application is a continuation application of U.S. patent application Ser. No. 14/001,078, filed 22 Aug. 2013, which is the National Stage of International Application No. PCT/GB2012/050432, filed 24 Feb. 2012, which claims priority from and the benefit of U.S. Provisional Patent Application Ser. No. 61/475,912 filed on 15 Apr. 2011 and United Kingdom Patent Application No. 1103255.4 filed on 25 Feb. 2011. The entire contents of these applications are incorporated herein by reference.

BACKGROUND OF THE INVENTION

The present invention relates to a mass spectrometer and method of mass spectrometry.

Curved or non linear geometry RF ion guides are known. Curved geometry ion guides allow more compact mass spectrometers to be designed compared to mass spectrometers with linear ion guides. Non linear geometry ion guides may also be used to reduce the amount of neutral or non-ionised species reaching an ion detector.

In some commercial mass spectrometers a gas filled curved geometry RF ion guide may be utilised as a collision gas cell. The pressure of the gas (e.g. Argon) within the collision gas cell is generally between $10^{-3}$ to $10^{-2}$ mbar.

Parent or precursor ions which are accelerated into the collision cell are fragmented by Collisionally Induced Dissociation ("CID") to form product ions. The product ions are then analysed by a downstream mass analyser. In some cases parent or precursor ions may be selected by an upstream mass filter prior to fragmentation.

In a conventional RF ion guide radial confinement is achieved by applying inhomogeneous fields oscillating at RF frequencies. Application of these oscillating fields results in a pseudo-potential which acts to confine ions within the ion guide.

The pseudo-potential (R,Z) within an RF ring stack comprising a plurality of electrodes each having an aperture as a function of radial distance R and axial position Z is given by:

$$\Psi(R, Z) := \frac{z \cdot e \cdot Vo^2}{4 \cdot m \cdot \omega^2 \cdot Zo^2} \cdot \frac{I1\left(\frac{R}{Zo}\right)^2 \cdot \cos\left(\frac{Z}{Zo}\right)^2 + I0\left(\frac{R}{Zo}\right)^2 \cdot \sin\left(\frac{Z}{Zo}\right)^2}{I0\left(\frac{Ro}{Zo}\right)^2} \quad (1)$$

wherein m is the mass of the ion, e is the electronic charge, Vo is the peak RF voltage, ω is the angular frequency of the RF voltage, Ro is the radius of the aperture, Zo.π is the centre to centre spacing between ring electrodes, I0 is a zeroth order modified Bessel function of the first kind, and I1 is a first order modified Bessel function of the first kind.

The RF voltage applied to adjacent ring electrodes is preferably 180° out of phase.

The pseudo-potential field for a quadrupole rod set ion guide as a function of radial distance r is given by:

$$V^*(r) = \frac{e \cdot V_0^2 \cdot r^2}{4\omega m r_0^4} \quad (2)$$

wherein $r_0$ is the internal radius of the quadrupole rod set.

The RF voltage applied to one set of opposing rods is 180° out of phase to that applied to the other set of opposing rods.

From Eqns. 1 and 2 it can be seen that the amplitude of the pseudo-potential is inversely proportional to the mass to charge ratio of ions within the guide.

In order to perform CID fragmentation, parent or precursor ions are arranged to enter the collision gas cell from a region maintained at a relatively low pressure with a kinetic energy which is sufficient to cause fragmentation of the parent or precursor ions by collisions with the target gas. The ions may be arranged to have a kinetic energy of between 10 and 100 eV. Ions entering the gas cell lose kinetic energy as they collide with the target gas and eventually reach thermal energy. This process is called collisional cooling.

However, at the entrance of a curved gas cell where ions have highest kinetic energy, the pseudo-potential field acts in the opposing direction to the direction in which the ions are travelling and must be sufficiently high to ensure that ions are effectively confined within the gas cell during the period in which collisional cooling is occurring. If the confining force is too small then ions may be lost by collision with the electrodes or may exit the ion guide in a radial direction.

As the pseudo-potential force is inversely dependent on the mass to charge ratio of ions, the amplitude of the RF potential must be increased for higher mass to charge ratio ions to minimise these losses. At higher RF amplitudes low mass to charge ratio product ions from high mass to charge ratio parent or precursor ions may be lost due to mass instability within the RF field. This low mass cut-off effect is well known in RF devices operated at high voltage.

U.S. Pat. No. 6,891,157 discloses a curved ion guide.

WO 2005/067000 discloses an ion extraction device.

WO 2009/036569 discloses a collision cell having a curved section.

It is desired to provide an improved device.

SUMMARY OF THE INVENTION

According to an aspect of the present invention there is provided a non-linear ion guide comprising:

a plurality of electrodes; and an ion guiding region arranged between the plurality of electrodes, wherein the ion guiding region curves at least in a first (x) direction;

wherein the non-linear ion guide further comprises:

a first device arranged and adapted to apply a DC voltage to at least some of the electrodes in order to form, in use, a DC potential well which acts to confine ions within the ion guiding region in the first (x) direction.

The non-linear ion guide is preferably curved.

The first device may be arranged and adapted to vary the DC voltage with time.

The ion guide preferably further comprises a second device arranged and adapted to apply an AC or RF voltage to at least some of the electrodes in order to form, in use, a pseudo-potential well which acts to confine ions within the ion guiding region in a second (y) direction.

The second (y) direction is preferably substantially orthogonal to the first (x) direction.

The second device may be arranged and adapted to vary the amplitude and/or frequency of the AC or RF voltage with time.

The second device may be arranged and adapted so that the amplitude and/or frequency of the AC or RF voltage applied to electrodes varies along the length of the ion guide.

The plurality of electrodes preferably comprises a plurality of planar electrodes arranged generally parallel to the plane of ion travel through the ion guide.

According to another embodiment the electrodes may have one or more apertures through which ions are transmitted, in use, wherein the plurality of electrodes are arranged generally orthogonal to the plane of ion travel through the ion guide.

Each electrode may be sub-divided into two, three, four, five, six, seven, eight, nine, ten or more than ten electrode segments.

One or more DC voltages may be applied to one or more of the electrode segments in order to confine ions within the ion guiding region in a direction parallel to the plane or direction of curvature of the ion guide.

AC or RF voltages may be applied to one or more of the electrode segments in order to confine ions within the ion guiding region in a direction orthogonal to the plane or direction of curvature of the ion guide.

The plurality of electrodes preferably comprises an array of first electrodes arranged along the first (x) direction and an array of second electrodes also arranged along the first (x) direction, wherein the array of first electrodes is spaced apart from the array of second electrodes in a second (y) direction which is substantially orthogonal to the first (x) direction.

The ion guide preferably further comprises a second device arranged and adapted to apply an AC or RF voltage to at least some of the array of first electrodes and/or to at least some of the array of second electrodes in order to form, in use, a pseudo-potential well which acts to confine the ions within the ion guide in the second (y) direction.

The first device is preferably arranged and adapted to apply DC voltages to the array of first electrodes and/or the array of second electrodes so that ions are confined within the ion guiding region in the first (x) direction.

The array of first electrodes preferably comprises a plurality of planar electrodes arranged in a first plane and the array of second electrodes comprises a plurality of planar electrodes arranged in a second plane, wherein the ion guiding region curves at least in a plane of curvature and wherein the first plane and/or the second plane are substantially parallel with the plane of curvature.

According to another embodiment the plurality of electrodes preferably comprises a plurality of third electrodes arranged in a plane substantially parallel or inclined to the first (x) direction and a plurality of fourth electrodes also arranged in a plane substantially parallel or inclined to the first (x) direction, wherein the plurality of third electrodes are spaced apart from the plurality of fourth electrodes in a second (y) direction which is substantially orthogonal to the first (x) direction.

The plurality of electrodes preferably further comprises a plurality of fifth electrodes arranged in a plane substantially orthogonal or inclined to the first (x) direction and a plurality of sixth electrodes also arranged in a plane substantially orthogonal or inclined to the first (x) direction, wherein the plurality of fifth electrodes are spaced apart from the plurality of sixth electrodes in the first (x) direction.

According to an embodiment the first device is preferably arranged and adapted to apply DC voltages to at least some of the fifth electrodes and/or to at least some of the sixth electrodes so that ions are confined within the ion guiding region in the first (x) direction.

The ion guide preferably further comprises a second device arranged and adapted to apply an AC or RF voltage to at least some of the third electrodes and/or to at least some of the fourth electrodes in order to form, in use, a pseudo-potential well which acts to confine the ions within the ion guide in the second (y) direction.

The plurality of third electrodes preferably comprises a plurality of planar electrodes arranged substantially in a first plane and the plurality of fourth electrodes comprises a plurality of planar electrodes arranged substantially in a second plane, wherein the ion guiding region curves at least in a plane of curvature and wherein the first plane and/or the second plane are substantially parallel with the plane of curvature.

The ion guide preferably further comprises a third device arranged and adapted to apply one or more voltages to the plurality of electrodes in order to urge ions along at least a portion of the length of the ion guide.

The third device is preferably arranged and adapted:

(i) to apply or maintain one or more non-zero DC voltage gradients along at least a portion of the length of the ion guide in order to urge at least some ions along at least a portion of the length of the ion guide; and/or (ii) to apply one or more transient DC voltages or transient DC voltage waveforms to at least some of the electrodes in order to urge at least some ions along at least a portion of the length of the ion guide.

The ion guiding region or ion guide may according to an embodiment curve in a plane of curvature, wherein the plane of curvature forms an angle θ with the first (x) direction and wherein θ is selected from the group consisting of: (i) 0-10°; (ii) 10-20°; (iii) 20-30°; (iv) 30-40°; (v) 40-50°; (vi) 50-60°; (vii) 60-70°; (viii) 70-80°; and (ix) 80-90°.

According to an embodiment the ion exit region of the ion guide may be elevated or depressed relative to an ion entrance region of the ion guide.

According to an embodiment the plurality of electrodes may be aligned in a plane of curvature which is inclined relative to the first (x) direction.

According to an embodiment one or more DC potential wells may be formed at different positions and/or are formed at different times within the ion guide so that ions may be switched between different paths through the ion guide.

According to an embodiment the height and/or depth and/or width of the DC potential well is arranged to vary, decrease, progressively decrease, increase or progressively increase along or around the length of the ion guiding region.

The DC potential well may according to an embodiment be arranged to vary along the length of the ion guiding region so as to funnel ions along or around the length of the ion guiding region.

According to an aspect of the present invention there is provided an ion mobility spectrometer or separator or a differential ion mobility spectrometer comprising a non-linear ion guide as described above.

According to an aspect of the present invention there is provided a mass spectrometer comprising either:

(i) a non-linear ion guide as described above; or (ii) an ion mobility spectrometer or separator or a differential ion mobility spectrometer as described above.

According to an aspect of the present invention there is provided a method of guiding ions comprising:

providing a non-linear ion guide comprising a plurality of electrodes with an ion guiding region arranged between the plurality of electrodes, wherein the ion guiding region curves at least in a first (x) direction;

wherein the method further comprises:

applying a DC voltage to at least some of the electrodes in order to form a DC potential well which acts to confine ions within the ion guiding region in the first (x) direction.

The method preferably further comprises applying an AC or RF voltage to at least some of the electrodes in order to form a pseudo-potential well which acts to confine ions within the ion guiding region in a second (y) direction.

The second (y) direction is preferably substantially orthogonal to the first (x) direction.

According to a preferred embodiment of the present invention there is provided a non-linear geometry RF ion guide. The RF ion guide is preferably curved. Ion confinement parallel to the plane or direction of curvature of the device is preferably provided by a substantially non-mass to charge ratio dependent DC electric field.

The confining field, parallel to the plane or direction of curvature of the device, is preferably substantially a DC field.

The preferred embodiment represents a significant improvement in the art in that advantageously ions are not mass selectively confined in the direction that the ion guide curves.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; and (xx) a Glow Discharge ("GD") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic or orbitrap mass analyser; (x) a Fourier Transform electrostatic or orbitrap mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wein filter; and/or (k) a device or ion gate for pulsing ions; and/or (l) a device for converting a substantially continuous ion beam into a pulsed ion beam.

The mass spectrometer may further comprise either:

(i) a C-trap and an Orbitrap® mass analyser comprising an outer barrel-like electrode and a coaxial inner spindle-like electrode, wherein in a first mode of operation ions are transmitted to the C-trap and are then injected into the Orbitrap® mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the Orbitrap® mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

The ion mobility spectrometer according to the preferred embodiment may comprise a plurality of electrodes each having an aperture through which ions are transmitted in use. One or more transient DC voltages or potentials or one or more DC voltage or potential waveforms are preferably applied to the electrodes comprising the ion mobility spectrometer in order to urge ions along the length of the ion mobility spectrometer.

According to the preferred embodiment the one or more transient DC voltages or potentials or the one or more DC voltage or potential waveforms create: (i) a potential hill or barrier; (ii) a potential well; (iii) multiple potential hills or barriers; (iv) multiple potential wells; (v) a combination of a potential hill or barrier and a potential well; or (vi) a combination of multiple potential hills or barriers and multiple potential wells.

The one or more transient DC voltage or potential waveforms preferably comprise a repeating waveform or square wave.

The AC or RF voltage preferably has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; (xi) 500-550 V peak to peak; (xxii) 550-600 V peak to peak; (xxiii) 600-650 V peak to peak; (xxiv) 650-700 V peak to peak; (xxv) 700-750 V peak to peak; (xxvi) 750-800 V peak to peak; (xxvii) 800-850 V peak to peak; (xxviii) 850-900 V peak to peak; (xxix) 900-950 V peak to peak; (xxx) 950-1000 V peak to peak; and (xxxi) >1000 V peak to peak.

The AC or RF voltage preferably has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The ion guide may be maintained at a pressure selected from the group comprising: (i) >0.001 mbar; (ii) >0.01 mbar; (iii) >0.1 mbar; (iv) >1 mbar; (v) >10 mbar; (vi) >100 mbar; (vii) 0.001-0.01 mbar; (viii) 0.01-0.1 mbar; (ix) 0.1-1 mbar; (x) 1-10 mbar; and (xi) 10-100 mbar.

BRIEF DESCRIPTION OF THE DRAWINGS

Various embodiments of the present invention will now be described, by way of example only, together with other arrangements given for illustrative purposes only and with reference to the accompanying drawings in which.

DETAILED DESCRIPTION OF THE PREFERRED EMBODIMENTS

A known ion guide will now be described with reference to FIGS. 1A and 1B.

Figure 1A:
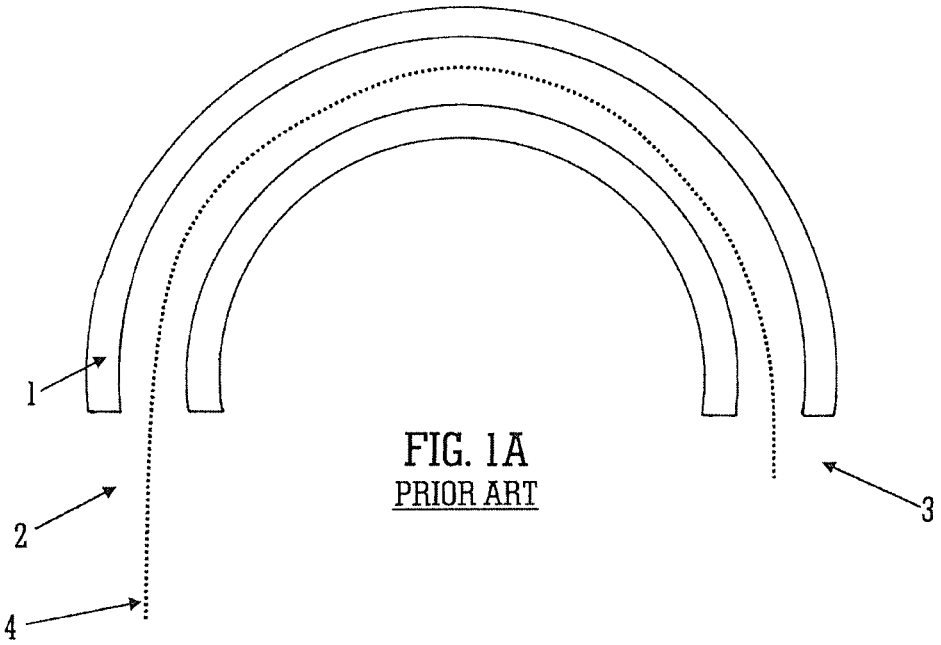
FIG. 1A PRIOR ART
FIG. 1A shows a known curved ion guide illustrating the trajectory of an ion having a relatively low mass to charge ratio and FIG. 1B illustrates the trajectory of an ion having a relatively high mass to charge ratio.

FIG. 1A shows a known ion guide comprising a curved quadrupole rod set gas cell 1 having an ion entrance 2 and an ion exit 3. The trajectory 4 of an ion having a relatively low mass to charge ratio is shown entering and then passing through the gas cell 1.

Figure 1B:
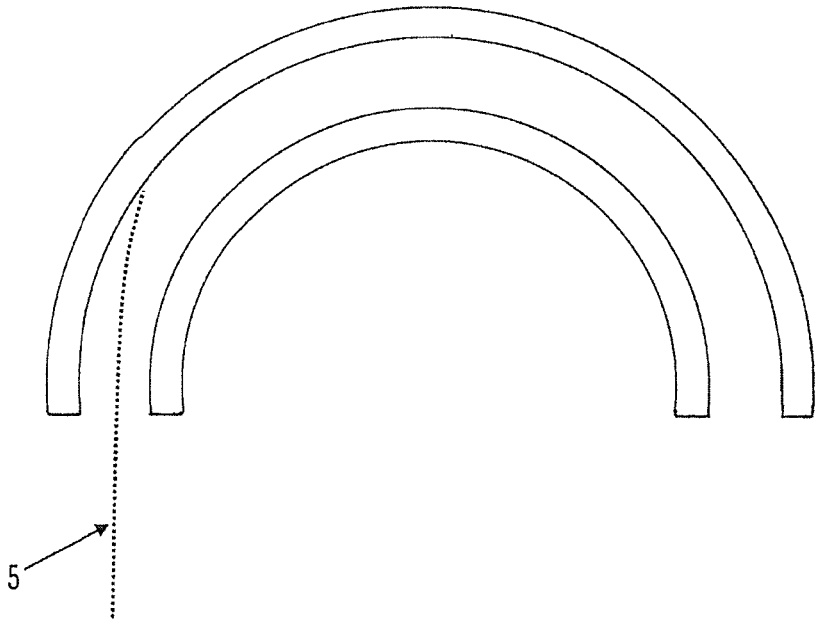
FIG. 1B PRIOR ART

FIG. 1B shows the same device operating under the same conditions but showing the trajectory 5 of an ion having a relatively high mass to charge ratio. The pseudo-potential field is insufficient to confine the ion having a relatively high mass to charge ratio within the gas cell 1 and as a result the ion is lost to the rod.

Figure 2A:
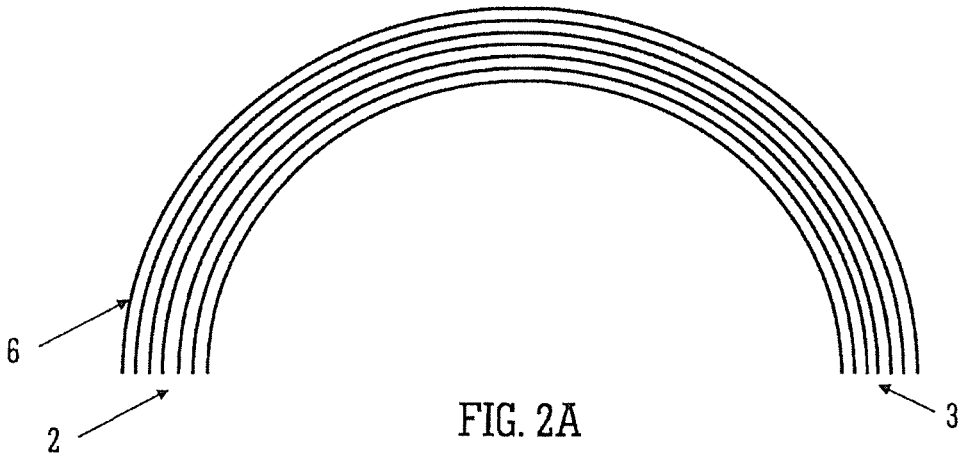
FIG. 2A shows an ion guide according to an embodiment of the present invention and FIG. 2B shows a cross sectional view of the ion guide shown in FIG. 2A.
Figure 2B:
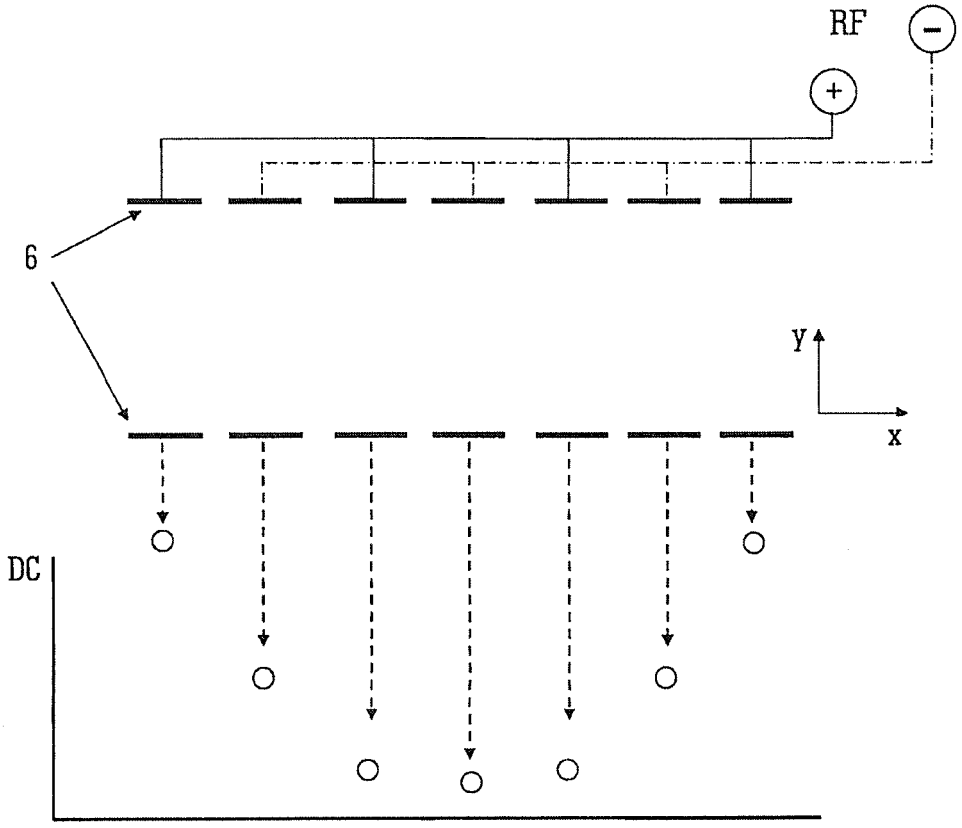

FIG. 2A shows a curved ion guide according to a preferred embodiment of the present invention in the plane of curvature of the ion guide. The curved ion guide preferably comprises an array of curved electrodes 6 having an ion entrance 2 and an ion exit 3. FIG. 2B shows a cross-sectional view of the ion guide at the ion entrance 2 in a plane normal to the plane of curvature. The two parallel arrays of curved electrodes 6 are preferably supplied with an RF potential wherein adjacent electrodes are preferably supplied with a RF voltage which is preferably 180° out of phase. This arrangement provides RF confinement in the y (vertical) direction which is orthogonal to the plane or direction of curvature of the ion guide.

The graph at the bottom of FIG. 2B shows the form of an additional DC potential which is preferably applied to the electrodes 6. The DC potential preferably acts to confine ions in the x (horizontal) direction i.e. in a direction parallel to the plane or direction of curvature of the ion guide.

As ions enter the device at or via the ion entrance 2 the ions preferably experience a DC confining force which is non mass to charge ratio dependent. The DC confining force preferably acts to oppose the direction of the ions and allows ions of all mass to charge ratios to be confined simultaneously during collisional cooling. The preferred embodiment is, therefore, particularly advantageous.

Figure 3A:
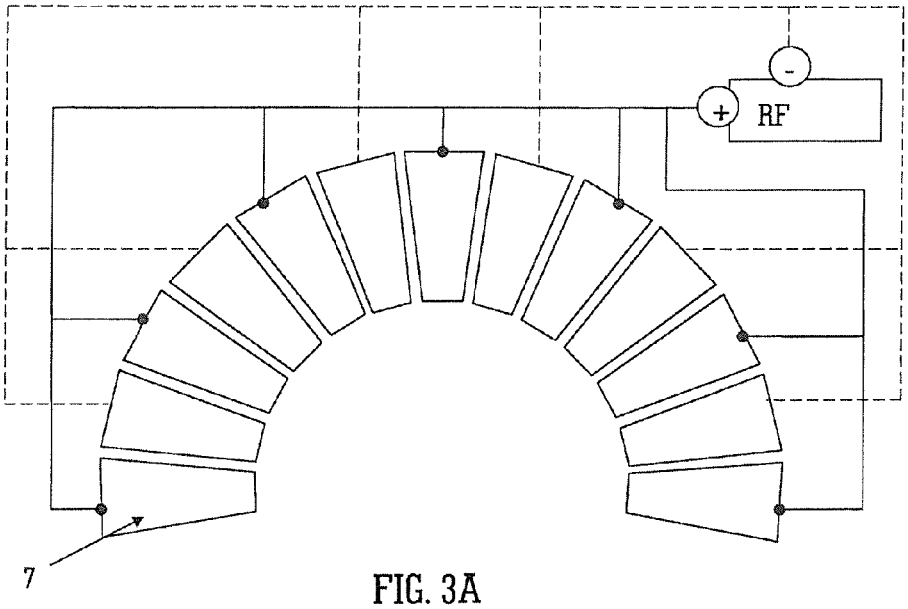
FIG. 3A shows an ion guide according to another embodiment of the present invention and FIG. 3B shows a cross sectional view of the ion guide shown in FIG. 3A.
Figure 3B:
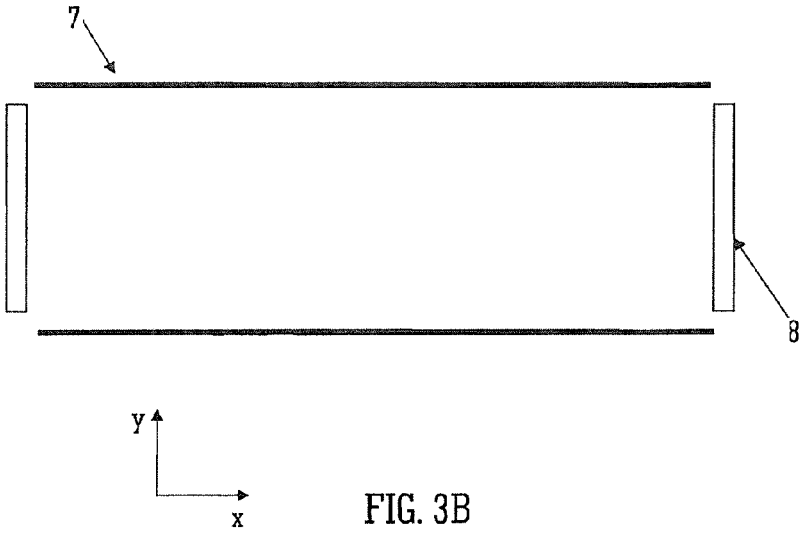

FIG. 3A shows another embodiment of the present invention. Upper and lower RF electrodes 7 are preferably provided and RF electrodes 7 along the length of the ion guide are preferably supplied with alternating phases of a RF voltage. The RF electrodes 7 are preferably aligned in segments running at right angles to the central axis of the device. FIG. 3B shows a cross-sectional view of the device. Vertical plates or electrodes 8 in FIG. 3B are preferably supplied with a DC potential which preferably acts effectively to confine ions in the x (horizontal) direction i.e. in a direction parallel to the plane or direction of curvature of the ion guide. The horizontal plates or RF electrodes 7 of each segment are preferably maintained at the same phase of the RF voltage.

As ions enter the device the ions preferably experience a non mass to charge ratio dependent DC confining force which preferably acts to oppose the direction of the ions and which allows ions of all mass to charge ratios to be confined simultaneously.

Figure 4A:
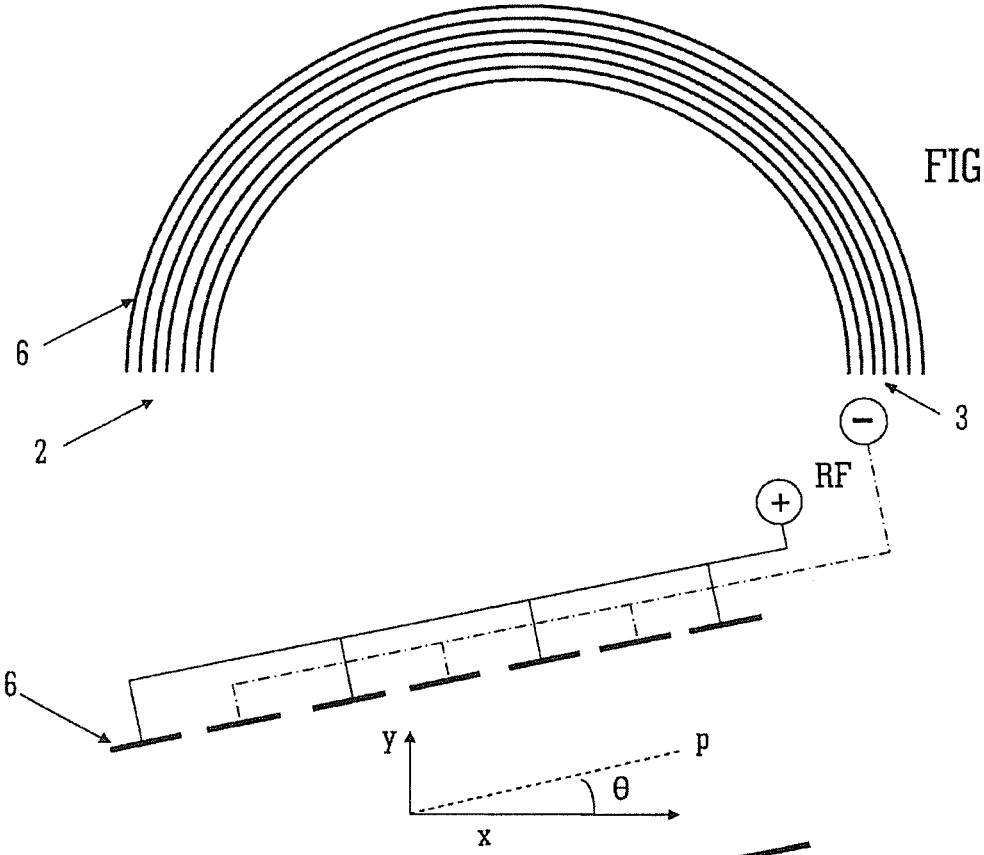
FIGS. 4A and 4B shows a further embodiment similar to the embodiment shown in FIGS. 2A-2B wherein the plane of curvature is rotated or inclined.
Figure 4B:
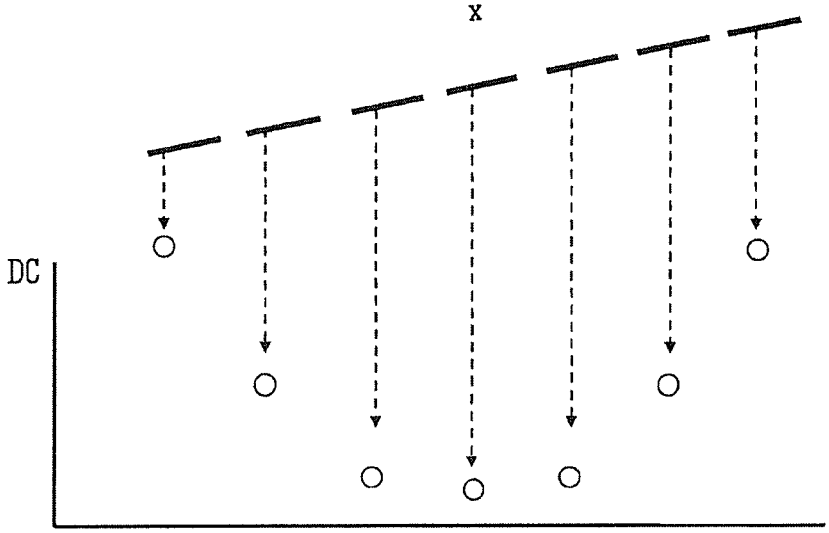

FIGS. 4A-4B show a further embodiment wherein the plane of curvature p of the ion guide is rotated by or tilted by an angle θ with respect to the x axis. The angle θ may be between ±90°. For example, according to an embodiment the angle θ may fall within the range 0-10°, 10-20°, 20-30°, 30-40°, 40-50°, 50-60°, 60-70°, 70-80° or 80-90°. In the particular embodiment shown in FIG. 4 the exit of the ion guide is elevated with respect to the entrance.

Figure 5A:
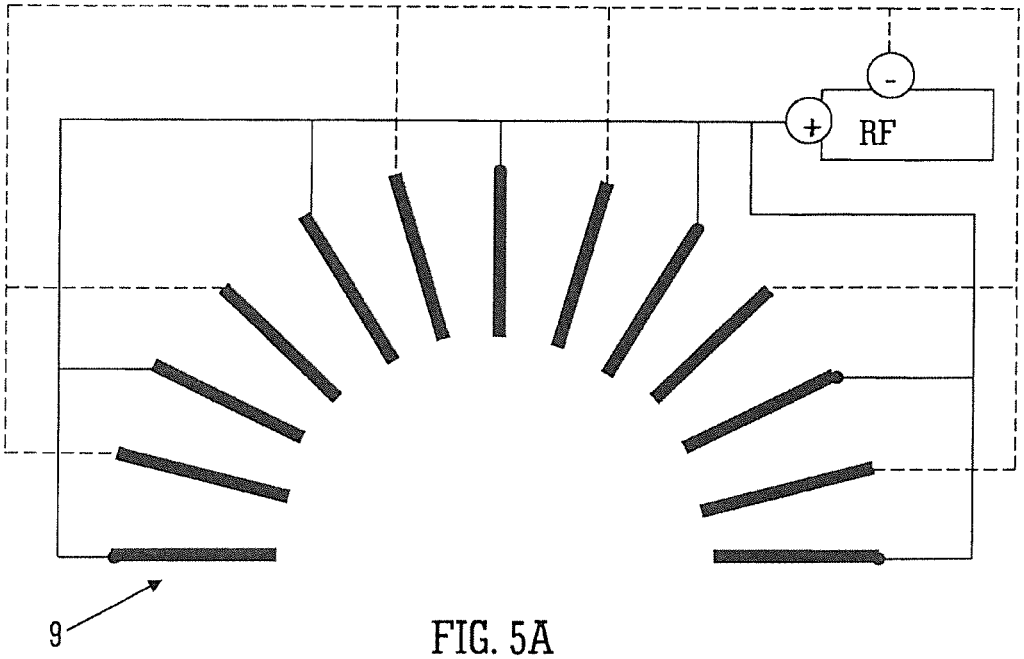
FIGS. 5A and 5B show an embodiment wherein the ion guide comprises a stacked ring ion guide wherein each ring is split into four segments.
Figure 5B:
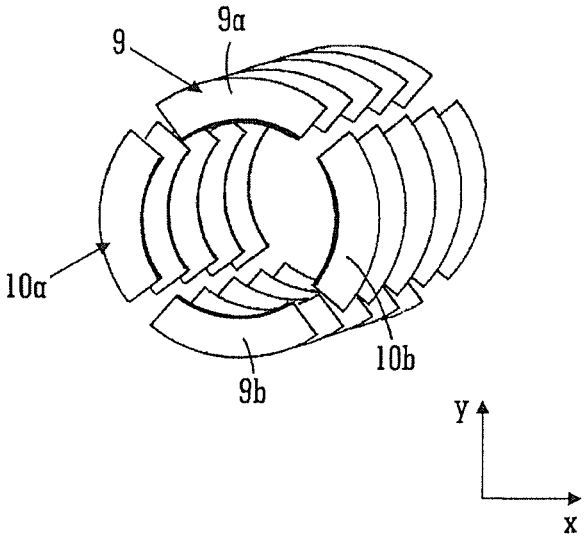

FIGS. 5A-B show an embodiment which has several similarities to the embodiment shown and described with reference to FIG. 3. According to this embodiment the ion guide is constructed as a stacked ring ion guide with each ring split into four segments. With reference to the embodiment shown in FIG. 5B each ring comprises an upper segment 9*a*, a lower segment 9*b* and two substantially vertical segments 10*a*,10*b*.

According to a preferred embodiment a DC potential is applied to the vertical segments 10*a*,10*b* which are arranged generally orthogonal to the direction or plane of curvature of the ion guide. An RF voltage is applied to the upper and lower segments 9*a*,9*b*. The RF voltage is preferably applied so that adjacent (split) rings are maintained at opposing RF phases. According to an embodiment both the upper and lower segments 9*a*,9*b* of a particular (split) ring are preferably maintained at the same RF phase.

According to this embodiment ion confinement parallel to the plane or direction of curvature is preferably dominated by the applied DC voltage.

Further embodiments are contemplated wherein the ion guides shown and described in relation to FIGS. 3 and 5 may also be inclined in a similar manner to the embodiment shown and described with reference to FIG. 4.

According to an embodiment ions may additionally be urged along and/or through the length of the ion guide by application of a DC potential acting along the central axis of the device. Alternatively, ions may be urged along and/or through the device by application of a travelling or transient DC voltage or wave or a pseudo-potential wave. The travelling DC wave preferably comprises one or more transient DC voltages or one or more DC voltage waveforms which are preferably applied to the electrodes forming the ion guide.

The ion guide may be used as an ion mobility spectrometer or separator or IMS separation device. Alternatively, the ion guide may be used as a differential ion mobility separation device wherein ions are separated on the basis of their rate of change of ion mobility with electric field strength.

The ion guide may follow any non-linear or curved path. According to an embodiment there may be no direct line sight along the central ion guiding axis of the ion guide. Embodiments are contemplated wherein the ion guide is C-shaped, S-shaped, V-shaped or has a generally tortuous shape.

The same principle of operation applies to a linear ion guide where ions enter the device from a low pressure region at an angle with respect to the central axis of the device. The form of the confining DC potential applied to the electrodes of the ion guide may vary over or along the length of the device to achieve maximum confinement efficiency.

According to an embodiment the amplitude of the DC confining potential may be arranged to vary with time. For example, an ion beam may be prevented from traversing the ion guide by lowering the DC confining potential for a defined time interval which effectively gates the ion beam.

According to a less preferred embodiment the internal dimensions of the ion guide may be arranged to vary along the length of the ion guide. For example, according to an embodiment the ion guide may have a curved ion funnel geometry. Alternatively, the amplitude and/or frequency of the RF voltage applied to the electrodes forming the ion guide may vary along the length of the device to create a similar ion funnelling effect.

According to an embodiment multiple DC potential wells can be created within the ion guide or ion guiding region and ions can be switched between different paths as they are transmitted through the ion guide. For example, two or more ion guiding regions or paths may merge into a single ion guiding region or path or, vice versa, a single ion guiding region or path may split into two or more ion guiding regions or paths.

Although the present invention has been described with reference to the preferred embodiments, it will be understood by those skilled in the art that various changes in form and detail may be made without departing from the scope of the invention as set forth in the accompanying claims.

The invention claimed is:

1. A non-linear ion guide comprising:

a plurality of electrodes; and an ion guiding region arranged between said plurality of electrodes, wherein said ion guiding region curves at least in a first plane or direction; and a first device arranged and adapted to apply a DC voltage to at least some of said plurality of electrodes in order to form, in use, a DC potential well which acts to confine ions within said ion guiding region in a radial direction.

2. A non-linear ion guide as claimed in claim 1, wherein ions are confined in said radial direction in a non-mass to charge ratio dependent manner.

3. A non-linear ion guide as claimed in claim 1, wherein ions are confined in a second direction by an AC or RF potential or pseudo-potential, wherein said second direction is orthogonal to said direction of DC confinement.

4. A non-linear ion guide as claimed in claim 1, wherein said DC potential well acts to confine ions parallel to the plane or direction of curvature of said ion guide.

5. A non-linear ion guide as claimed in claim 1, wherein said DC potential well acts to oppose the radial direction of motion of ions entering or passing through said ion guide to substantially allow ions of all mass to charge ratios to be confined simultaneously.

6. A non-linear ion guide as claimed in claim 1, comprising a plurality of planar electrodes arranged generally parallel or inclined relative to the plane or direction of curvature of said ion guide.

7. A non-linear ion guide as claimed in claim 1, comprising a device arranged and adapted to urge at least some ions along at least a portion of the length of the ion guide along its central axis.

8. A non-linear ion guide as claimed in claim 7, wherein said device is arranged and adapted to apply or maintain one or more non-zero DC voltage gradients along at least a portion of the length of the ion guide, or to apply one or more transient DC voltages or transient DC voltage waveforms to at least some of the electrodes.

9. A non-linear ion guide as claimed in claim 1, wherein a potential varies along the length of the ion guiding region or wherein the dimensions of the ion guide vary along the length of the ion guiding region so as to funnel ions along or around the length of the ion guiding region.

10. A non-linear ion guide as claimed in claim 1, wherein one or more DC potential wells are formed at different positions or are formed at different times within said ion guide so that ions may be switched between different paths through said ion guide.

11. A non-linear ion guide as claimed in claim 1, wherein said ion guiding region curves at least in a first direction, and wherein said DC potential acts to confine ions within said ion guiding region in said first direction.

12. A non-linear ion guide as claimed in claim 1, wherein said first direction is orthogonal to the central axis of the ion guide.

13. A non-linear ion guide comprising:

a plurality of electrodes;

an ion guiding region arranged between said plurality of electrodes, wherein said ion guiding region curves at least in a first plane or direction; and a first device arranged and adapted to apply a DC voltage to at least some of said plurality of electrodes in order to form, in use, a DC potential well which acts to confine ions within said ion guiding region in a radial direction, wherein ions are not substantially confined in said radial direction by an AC or RF potential or pseudo-potential.

14. A non-linear ion guide comprising:

a plurality of electrodes;

an ion guiding region arranged between said plurality of electrodes, wherein a central axis of said ion guiding region is curved; and a first device arranged and adapted to apply a DC voltage to at least some of said plurality of electrodes in order to form, in use, a DC potential well which acts to confine ions within said ion guiding region in a first direction orthogonal to said central axis while ions are transmitted through said ion guiding region along said central axis.

15. A non-linear ion guide as claimed in claim 14, further comprising a second device arranged and adapted to apply an AC or RF voltage to at least some of said plurality of electrodes in order to form, in use, a pseudo-potential well which acts to confine ions within said ion guiding region in a third direction, different from the first direction.

16. A non-linear ion guide as claimed in claim 14, wherein said third direction is substantially orthogonal to said first direction.

17. A non-linear ion guide as claimed in claim 14, wherein said plurality of electrodes comprises a plurality of planar electrodes arranged generally parallel to a plane of ion travel through said ion guide.

18. A non-linear ion guide as claimed in claim 14, wherein each electrode has one or more apertures through which ions are transmitted, in use, wherein said plurality of electrodes are arranged generally orthogonal to a plane or direction of ion travel through said ion guide.

19. A non-linear ion guide as claimed in claim 14, wherein said ion guiding region or ion guide curves in a plane of curvature, wherein said plane of curvature forms an angle $\theta$ with said first direction and wherein $\theta$ is selected from the group consisting of: (i) 0-10°; (ii) 10-20°; (iii) 20-30°; (iv) 30-40°; (v) 40-50°; (vi) 50-60°; (vii) 60-70°; (viii) 70-80°; and (ix) 80-90°.

20. A non-linear ion guide as claimed in claim 14, wherein an ion exit region of said ion guide is elevated or depressed relative to an ion entrance region of said ion guide.

* * * * *